United States Patent [19]

Astrupgaard et al.

[11] 4,328,759

[45] May 11, 1982

[54] SEWING MACHINE WITH A STITCH SETTING DEVICE

[75] Inventors: Svend Astrupgaard, Lyngby, Denmark; Heinz Petri, Kaiserslautern, Fed. Rep. of Germany

[73] Assignee: Pfaff Industriemaschinen GmbH, Kaiserslautern, Fed. Rep. of Germany

[21] Appl. No.: 142,155

[22] Filed: Apr. 21, 1980

[30] Foreign Application Priority Data

Apr. 25, 1979 [DE] Fed. Rep. of Germany ..... 2916642

[51] Int. Cl.[3] ..... D05B 27/22

[52] U.S. Cl. ..... 112/316

[58] Field of Search ..... 112/316, 317, 315, 314

[56] References Cited

U.S. PATENT DOCUMENTS

| | | | |
|---|---|---|---|
| 2,420,480 | 5/1947 | Ivandick | 112/316 |
| 2,430,207 | 11/1947 | Best | 112/316 |
| 2,488,084 | 11/1949 | Graesser | 112/316 |

*Primary Examiner*—H. Hampton Hunter

*Attorney, Agent, or Firm*—McGlew and Tuttle

[57] ABSTRACT

A sewing machine includes a material engaging part such as a dog which is engageable with a material workpiece to selectively feed it in a forward and a reverse direction. In addition, the sewing machine includes the usual mechanism for raising and lowering the dog so as to complete an advancing or reverse movement of the material. The dog is driven preferably by a mechanism which includes an eccentric which may be adjusted so as to vary the length of horizontal feeding movement of the dog while the elevational changes of the dog remain constant by a separate feeding control mechanism. The magnitude of movement of the dog is controlled in accordance with a stitch length to be sewed by a stitch setting device which includes a movable contacting member which is connected to the eccentric mechanism and is movable between two end positions in order to adjust by a selected amount the movement of the eccentric in driving the dog by a selected amount. The device also includes first and second setting members arranged on respective sides of a contacting member which may, for example, be in the form of a fluid operated piston and a setting member positioning means is connected to the two setting members so as to move them simultaneously in respective opposite directions and position them on respective opposite sides of the contacting member or piston so as to control the end positions of movement of the piston during the operation of the sewing machine. The piston rides in a fluid cylinder and fluid pressure may be applied to respective sides thereof for shifting the position of the piston for the purposes of reversing the direction of feeding movement of the material being sewn.

15 Claims, 6 Drawing Figures

SEWING MACHINE WITH A STITCH SETTING DEVICE

FIELD AND BACKGROUND OF THE INVENTION

This invention relates to sewing machines in general and, in particular, to a new and useful stitch setting device for adjusting the length of stitch which is sewn by a sewing machine.

A stitch setting device is known from German Pat. No. 1,027,970, in which a manually rotatable cam disc is provided as the setting member, and has a recess which, beginning from a zero position, grows uniformly larger to both sides of a concentric zero line. The curved surfaces of the recess form stop faces for a contact pin which is secured to a manually pivotable support and is connected through a multi-member linkage to the feed elements of the sewing machine. A tension spring acting on the support holds the pin in contact with the outer curved face whose radial distance from the concentric zero line determines the forward feed step. To reverse the sewing direction, the support is pivoted and the pin is brought into contact with the inner curved face. Since in either of the two positions, the contact pin is radially equally spaced from the concentric zero line, the feed steps in the forward and backward directions are equal to each other.

In order to secure a seam, the threads are frequently locked on both ends of the seam by sewing a short length alternately forwardly and backwardly, two or three times. To ensure a continuous operation, the forward sewing must be reversed to the backward sewing and vice versa as quickly as possible. For this purpose, it is known to connect the support carrying the contact pin to an air cylinder and to determine the instant of reversal, for example, by means of photocell controls or stitch counters.

However, experience has shown that quick reversals of the stitch setting device cause a premature wearing down of the contact pin and the stop faces of the cam disc. In addition, the train members of the linkage between the air cylinder and the contact pin which transmit the setting forces from the air cylinder up to the respective stop face of the cam disc are exposed to high bending and buckling stresses caused by the abrupt braking during the motion reversal, and thus, may deform or even break.

SUMMARY OF THE INVENTION

The present invention is directed to a stitch setting device which is suitable for quickly reversing the feed direction and in which the members of the transmission train are exposed to only small loads, in spite of the high switching speed.

In accordance with the invention, a stitch setting device is provided for adjusting the length of stitch by varying the magnitude of movement of the dog which engages the material which is being fed. The setting device includes a movable contacting member connected to the stitch movement control mechanism and which is movable between two end positions so as to adjust the workpiece dog shifting mechanism and thus vary the amount of movement of the material during each feed movement. The construction includes setting members which are disposed in the path of movement of the contacting member and on respective opposite sides thereof. The setting members are positioned by a control which is effective to move each of them in respective opposite directions so as to vary their position in respect to the contacting member and to provide stop limiting elements limiting the movement of the contacting member in each direction.

Due to the provision that the setting member or the contacting member of the stitch setting device is connected to the piston rod, and the respective other member to the housing of the pressure fluid operated cylinder, the cylinder and the setting and contacting members form a constructional unit. In this way, the functions hitherto performed in separate devices, namely, of producing a setting force and displacing a member of the stitch setting device relative to the other member, are now performed by a single interconnected mechanism. This is advantageous in that the number of component parts of the transmission train for reversing the feed direction is smaller than in the prior art devices.

Since the setting and contacting members are now connected to the piston rod or to the housing of the pressure fluid operated cylinder and the setting member is designed as two stop elements which are disposed concentrically of the longitudinal axis of the cylinder and are displaceable in opposite directions, both the setting motion of the setting member and the displacement of one member relative to the other during the feed direction reversal take place in the direction of the longitudinal axis of the pressure fluid operated cylinder. In consequence, the setting member and the contacting member remain axially aligned in any position and may be designed in a manner such that they always come into a surface contact with each other. Since the specific contact pressure produced is then only small, there is no risk that the setting or contacting member would be deformed, not even at high switching speeds.

According to a development of the invention, the stop elements are designed as two axial displaceable end parts limiting the travel path of the piston, with the piston acting as the contacting member. Due to the provision of using the piston of a pressure fluid operated cylinder producing the setting force directly as the contacting member of a stitch setting device, any connecting element between the piston and a separate contacting member is omitted and the number of component parts to be moved during the reversal of the feed direction is reduced to a minimum.

The strong impact forces produced as the piston abruptly impinges on the stop faces of the end parts are directly taken up by the end parts and transmitted through the housing of the pressure fluid operated cylinder and the component parts connecting the cylinder to the sewing machine, to the casing of the sewing machine. There is no risk of overstressing the transmission members driven by the piston rod, by the impact forces produced during the reversal.

In accordance with a further development of the invention, the end parts are guided in a cylinder sleeve and are provided with oppositely handed threads and are connected to each other by means of a setting collar which also has oppositely handed threads and is axially fixed relative to the cylinder sleeve. The end parts and the setting collar thus forms a closed casing encircling the cylinder sleeve and are variable in size. Since the setting collar is provided with a lefthand thread and a righthand thread for the two end parts, upon turning the setting part, the end parts are moved simultaneously in opposite directions. If the righthand and lefthand threads have equal pitches, the two end parts are equally spaced from a zero position in any set position, so that upon a reversal of the feed direction, the feed stop remains unchanged.

The axial position of the setting collar relative to the cylinder sleeve is advantageously insured by a holding ring which is secured to the cylinder sleeve and engages an annular groove of the setting collar.

To fix the end parts radially relative to the cylinder sleeve, guide pins are provided which extend parallel to this cylinder sleeve and are firmly fitted in the holding ring to project to both sides thereof. Guide bores receiving the guide pins are provided in the end parts.

In another embodiment of the stitch setting device, the stop elements are designed as two stop discs which are carried on the piston rod of the pressure fluid operated cylinder and are displaceable between two crossbars connected to the cylinder housing and acting as a contacting member. In this embodiment, the setting and contacting members are provided outside of the housing of the pressure fluid operated cylinder, so that, in such an application, a conventional cylinder piston system may be used. Since, in this case, the contacting member is connected to the housing of the pressure fluid operated cylinder, and the setting member is connected to the piston rod, the impact forces produced at the reversal of the feed direction are transmitted to the cylinder housing and then through the connecting component parts to the casing of the sewing machine.

In still another embodiment of the invention, the stop elements are designed as two stop discs which are carried by the piston rod of the pressure fluid operated cylinder, and a contacting piece forming the contacting member is provided on the casing of the sewing machine at a location between the discs. In this embodiment, a conventional cylinder piston system may again be used. The contacting member is connected to the housing of the pressure fluid operated cylinder indirectly through the sewing machine casing. The advantage of this design is that, upon reversing the speed direction, the impact forces produced which act on the contacting member are directly transferred to the casing of the sewing machine.

In the last two embodiments discussed above of the stitch setting device, in order to adjust the distance between the stop elements or stop discs, and thus, between the stop faces cooperating with the contacting member, the stop discs are provided with oppositely handed internal threads and are engaged on a correspondingly oppositely threaded, axially fixed sleeve which is mounted for rotation on the piston rod, and are secured against rotation.

Accordingly, it is an object of the invention to provide a sewing machine which includes a material engaging part engageable with a workpiece material to selectively feed the workpiece material in forward and reverse directions in respect to a sewing needle for sewing stitches of selected lengths in the workpiece and which includes a shifting mechanism for driving the material engaging member which is adjustable for varying the amount of movement of the material engaging member wherein the improvement comprises a stitch setting device for adjusting the length of the stitch by varying the magnitude of movement of the material engaging part and includes a movable contacting member connected to the shifting mechanism which is movable between two end positions to adjusting the shifting mechanism by a selected amount so as to vary the amount of movement of the material engaging part and further including first and second setting members disposed in the path of movement of the contacting member on respective opposite sides of the contacting member and setting member positioning means connected to each of the setting members so as to move them simultaneously in respective opposite directions and to vary the end position of movement of the contacting member in accordance with the adjusted position of the setting member.

A further object of the invention is to provide a sewing machine with an improved stitch setting device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figures 1, 2:
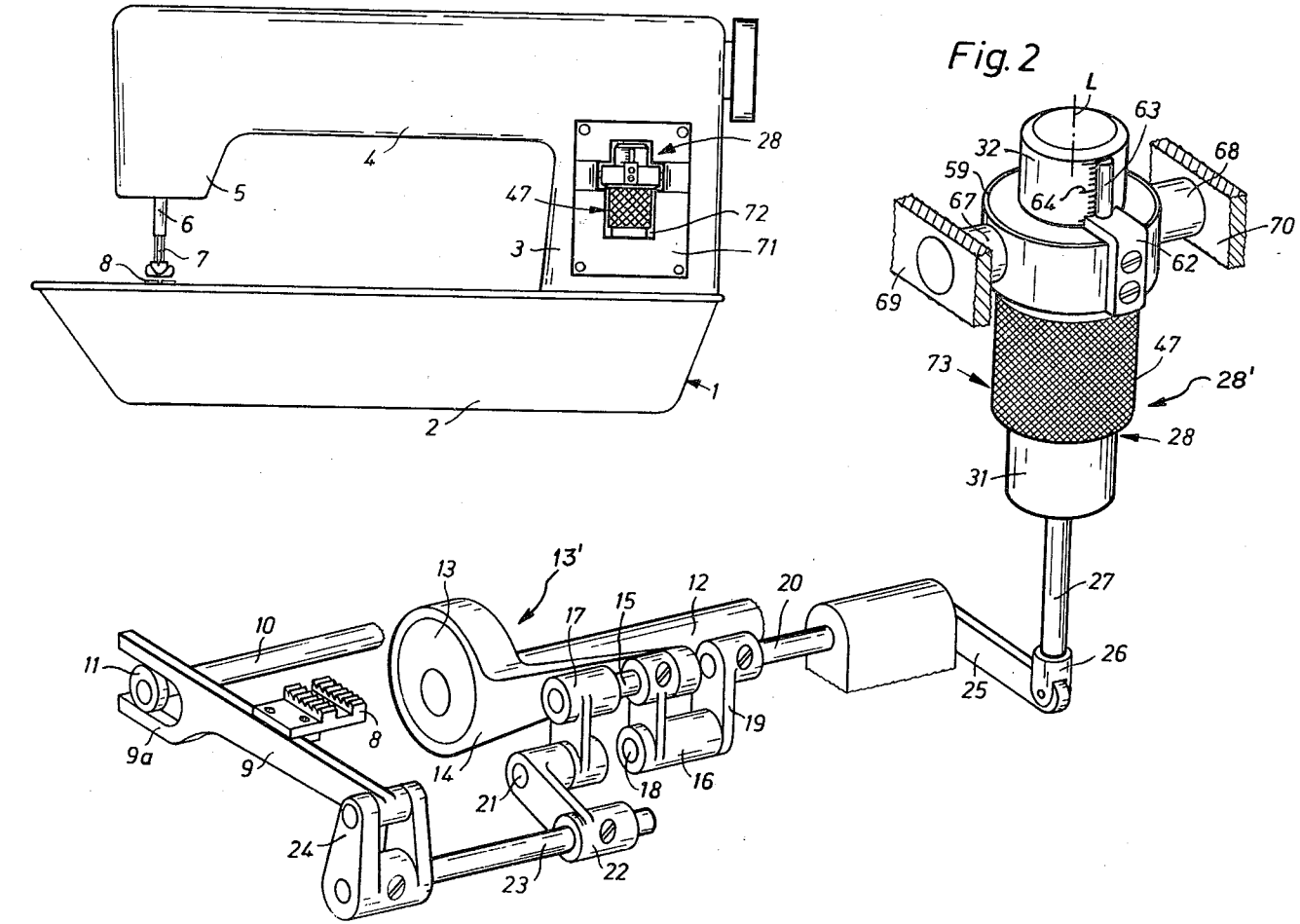
FIG. 1 is an elevational view of a sewing machine constructed in accordance with the invention.
FIG. 2 is a perspective view of a first embodiment of a stitch setting device and of the feed mechanism of the sewing machine.

Referring to the drawings in particular, the invention embodied therein in FIGS. 1 through 5, comprises, a sewing machine which includes a material engaging part or dog 8 which is engageable with a workpiece material in order to selectively feed it in either a forward or reverse direction so as to bring it in engagement with a reciprocating needle 7 for sewing stitches of selected lengths in the workpiece.

The horizontal movement of dog 8 is controlled by a shifting mechanism, generally designated 13', which includes a shifting eccentric 13 which is connected to dog 8 by a linkage mechanism and which is adjustable for varying the amount of movement of the dog horizontally or backwardly and forwardly.

In accordance with the invention, a stitch setting device, generally designated 28' is connected to shifting mechanism 13' so as to provide means for adjusting the length of stitch by varying the magnitude of movement of the dog 8 in the backward and forward directions. The stitch setting mechanism comprises a contacting member, generally designated A which is connected to the shifting mechanism 13' and which is movable between two end positions in order to adjust the shifting mechanism by a selected amount so as to vary the movement of the dog 8 by a selected amount.

The arrangement includes setting members, generally designated 31 and 32 and comprise first and second elements disposed in the path of movement of the contacting member on respective opposite sides thereof and limiting the movement of the contacting member to a movement in which the contacting member moves into engagement with a respective one of the setting members. The position of the setting members 31 and 32 is controlled by positioning means which is connected to the setting members and which is movable in a selected direction to move the setting members in respective directions so as to vary the end position of the movement of the contacting member in accordance with the adjusted position of the setting members which engage with the contact member in the respective end positions.

The sewing machine 1 comprises a lower casing 2, a post 3, an arm 4, and a head 5. The head 5 supports a needle bar 6 which is mounted in a manner known per se for reciprocating motion up and down and carries a thread guiding needle 7.

The sewn material is fed by means of a four motion feed dog 8 which is secured to a feed bar 9. Feed bar 9 has a forked end **9*a* engaging over a lifting eccentric 11 which is carried by a shaft 10. As shaft 10 rotates, eccentric 11 imparts to the feed dog 8** the vertical motion component necessary for executing the four motion sequence.

To produce the horizontal feed motion of feed dog 8, a shifting eccentric 13 is secured to a shaft 12 and is embraced by an eccentric bar 14. Two links 16 and 17 are hinged to eccentric bar 14 by means of a bolt 15. Link 16 is pivoted by means of a bolt 18 to a crank 19 which is secured to a setting shaft 20. Link 17 is pivoted by means of a bolt 21 to a crank 22 which is secured to a shaft 23. A forked crank 24 is secured to shaft 23 and hinged to feed bar 9.

A crank 25 is secured to setting shaft 20. Hinged to crank 25 is a forked head 26 which is secured to the piston rod 27 of a pressure fluid operated cylinder 28. Cylinder 28 is provided with a cylinder sleeve 29 which is open on both ends and in which the piston 30 firmly secured to piston rod 27 is guided. The ends of the cylinder sleeve 29 are closed by two caplike end parts 31 and 32. Each of end parts 31 and 32 is provided with a relatively deep annular slot 33, 34 into which cylinder sleeve 29 can penetrate. The portions extending into sleeve 29 of end parts 31, 32 are sealed against the sleeve by means of seal rings 35, 36, so that the sleeve and the end parts 31, 32 form together a closed pressure-tight cylinder chamber 37. The front faces of the portions of end parts 31, 32 extending into cylinder sleeve 29 form stop faces 38, 39, for piston 10.

End part 31 is provided with a tapped connection bore 40 for receiving a tube connection (not shown), so that a pressure fluid tube can be attached to end part 31. Connection bore 40 opens into an axially extending bore 41 which, in turn, opens into cylinder chamber 37. The diameter of bore 41 is sufficiently dimensioned to ensure a rapid flow of the pressure fluid between the wall of bore 41 and the piston rod 27 extending therethrough. Compressed air is preferably used as the pressure fluid. At the free end of end part 31, where piston rod 37 extends to the outside, bore 41 is sealed by a seal ring 42.

End part 32 is provided with a connection bore 43 for receiving a tube connection (not shown), so that a pressure fluid tube can be attached to end part 32. Connection bore 43 opens into an axially extending blind bore 44 which, in turn, opens into the cylinder chamber 37.

On its end portion adjacent stop face 38, end part 31 is provided with a lefthand threaded shoulder 45. End part 32 is provided on its end portion adjacent stop face 39 with a righthand threaded shoulder 46. Both threads have the same pitch. The two end parts 31, 32 are connected to each other by a setting collar 47. End parts 31, 32 and setting collar 47 form the housing 73 of a pressure fluid operated cylinder 28.

Setting collar 47 comprises a bearing ring 48 and an annular insert 49 which is firmly fixed to ring 48 and secured against rotation therein. Bearing ring 48 is provided with a righthand inner thread cooperating with threaded shoulder 46, and insert 49 is provided with a lefthand inner thread cooperating with threaded shoulder 45. An annular groove 52 is provided in bearing ring 48 adjacent the end of insert 49.

A holding ring 55 engaging annular groove 52 is mounted on cylinder sleeve 29 and is axially fixed by means of two guard rings 53, 54. Setting collar 47 is axially secured against cylinder sleeve 29 by holding ring 55. A plurality of guide pins 56 which extend parallel to the piston rod 27 and to both sides of holding ring 55 are firmly fitted in holding ring 55, to be received in guide bores 57, 58 of end parts 31, 32. Guide pins 56 extending into guide bores 57, 58 produce the effect that the two end parts 31, 32 cannot be turned relative to each other and can only be displaced in the axial direction.

Figure 3A:
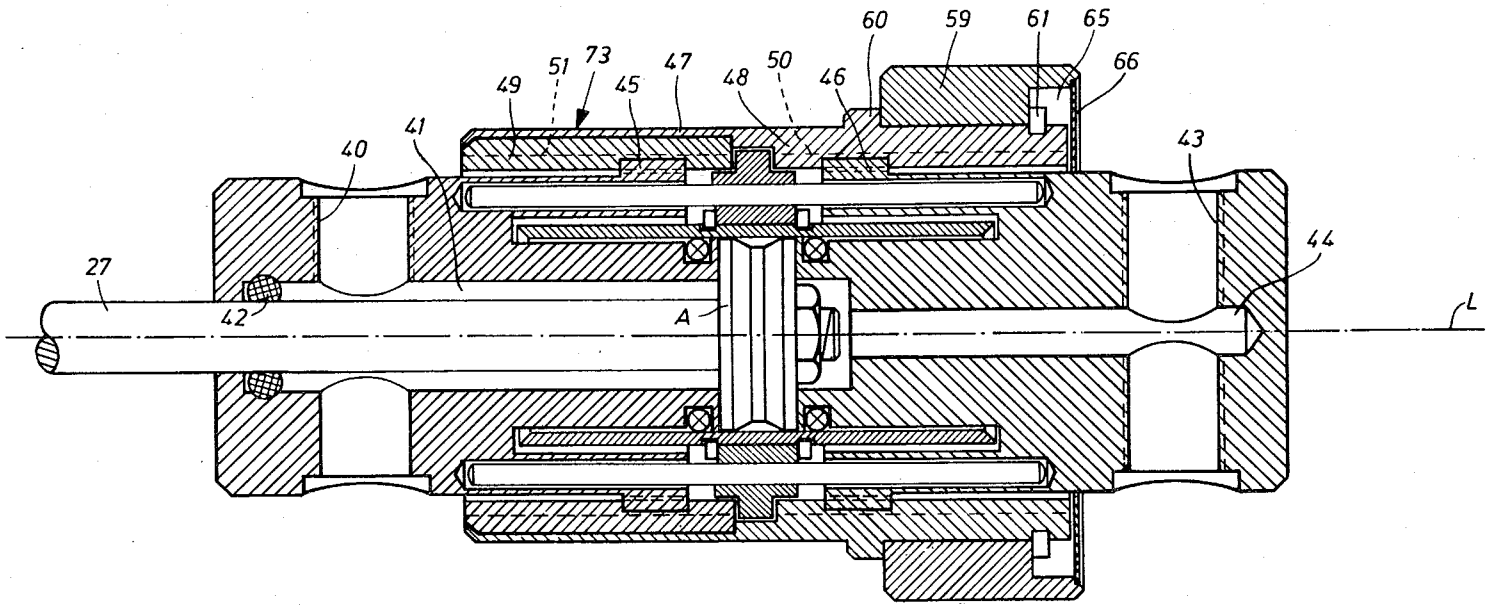
FIG. 3*a* is a sectional view of the pressure fluid operated cylinder of the stitch setting device, the upper portion showing the relative position of the end parts of the cylinder if a stitch length zero is set.
Figure 3B:
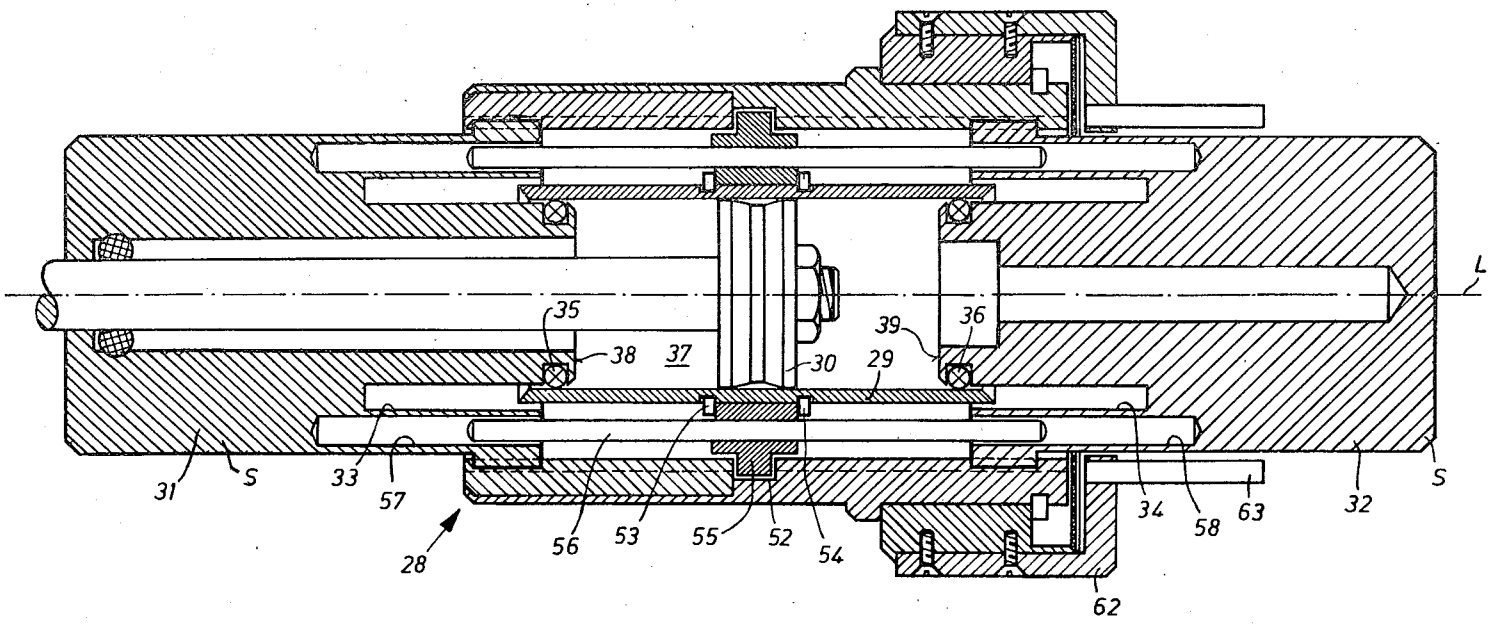
FIG. 3*b* is a view similar to FIG. 3*a* showing the ends parts in their position if a relatively long stitch length is set.

The effect of providing lefthand and righthand threads on the shoulders 45, 46 and in setting collar 47 is that upon turning collar 47, end parts 31, 32 are displaced in mutually opposite directions, toward each other if the collar is turned in one direction, and apart from each other if the collar is turned in the other direction. In the upper part of FIG. 3, the minimum possible distance between the two end parts is shown. In this case, piston 30 is in its zero position. The lower part of FIG. 3 shows end parts 31, 32 relatively widely spaced apart, with both stop faces 38, 39 being at the same distance from the zero position.

A receiving ring 59 which is axially fixed by means of a shoulder on ring 48 and a guard ring 61 is rotatably mounted on bearing ring 48. An angle piece 62 carrying an indicator pin 63 is secured on the outside to receiving ring 59. Indicator pin 63 is associated with a graduation or scale 64 provided on the outer surface of end part 32 so that the position of end part 32 relative to the axially fixed retaining ring 59 is indicated. The recess 65 of receiving ring 59 in which guard ring 61 is accommodated is closed by means of an annular disc 66. In addition, as shown in FIG. 2, two radially projecting bolts 67 and 68 are secured to the outside of receiving ring 59. By means of the bolts 67, 68, pressure fluid operated cylinder 28 is hinged to ribs 69, 70 which form portions of a mounting plate 71. Mounting plate 71 is secured to the post 3 of sewing machine 1 and covers a recess (not shown) provided in the wall of the post. Mounting plate 71 is provided with a window 72 through which setting collar 47 partly protrudes beyond the outside of mounting plate 71, so that it can easily be actuated by the operator.

In the above sewing machine, the pressure fluid operated cylinder 28 embodies the stitch setting device for determining the length of the feed step and the feed direction of feed dog 8. The setting member, generally designated S of the device is embodied by the two oppositely displaceable end parts 31 and 32, while the contacting member A is embodied by the piston 30.

Figure 4:
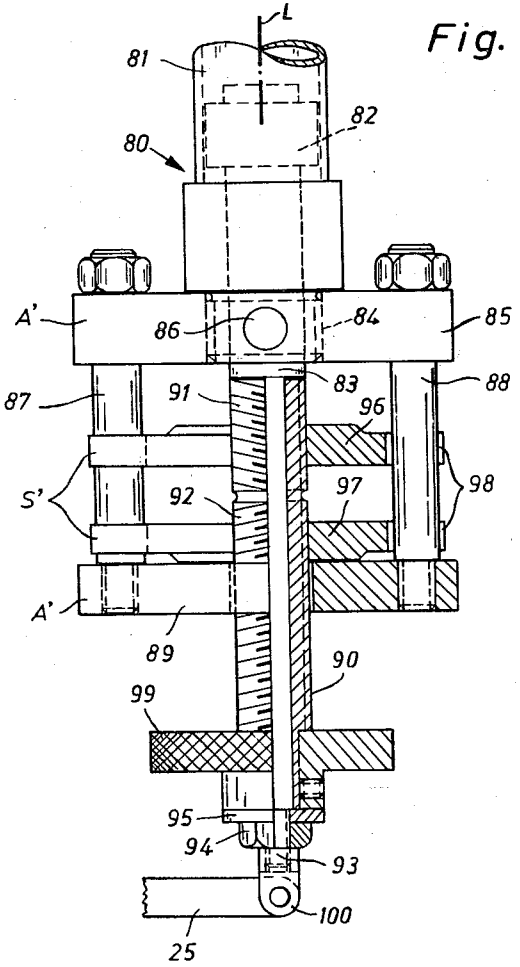
FIG. 4 is an elevation, partly in section, of a second embodiment of the stitch setting device.

In the embodiment of FIG. 4, a stitch setting device comprises a double-acting air cylinder 80 of conventional design of which the housing 81, piston 82, and piston rod 83 are shown in FIG. 4. Air cylinder 80 is screwed by means of a threaded shoulder 84 into a cross-bar 85. Cross-bar 85 is hinged by means of two bolts 86 to the casing (not shown) of the sewing machine. By means of two stay bolts, 87, 88, a cross-bar 89 is secured to and spaced from cross-bar 85. Cross-bars 85 and 89 and stay bolts 87, 88 together form a rigid frame. The portion of piston rod 83 extending outside of housing 81 has a reduced diameter. On this portion of piston rod 83, a threaded sleeve 90 is mounted for rotation. The external thread of threaded sleeve 90 is divided in two portions 91, 92, one being a lefthand thread and the other being a righthand thread. The free end of piston rod 82 terminates with a threaded stud 93 of smaller diameter. Threaded sleeve 90 is axially fixed by means of a nut 94 screwed onto threaded stud 93, and a washer 95.

Between the two cross-bars 85, 89, threaded sleeve 90 carries two stop discs 96, 97, each on one of the two portions 91, 92, which are provided with corresponding internal threads. Each of the stop discs 96, 97 is provided with two recesses 98 through which stay bolts 87, 88 extend. A setting wheel 99 is firmly fitted to the lower end of threaded sleeve 90. A forked head 100 is screwed to the free end of threaded stud 93. The forked head is hinged to the crank 25, as described in connection with the first embodiment.

In this stitch setting device, setting member S′ is embodied by the two oppositely displaceable stop discs 96, 97 while the contacting member A′ is embodied by the two cross-bars 85, 89.

Figure 5:
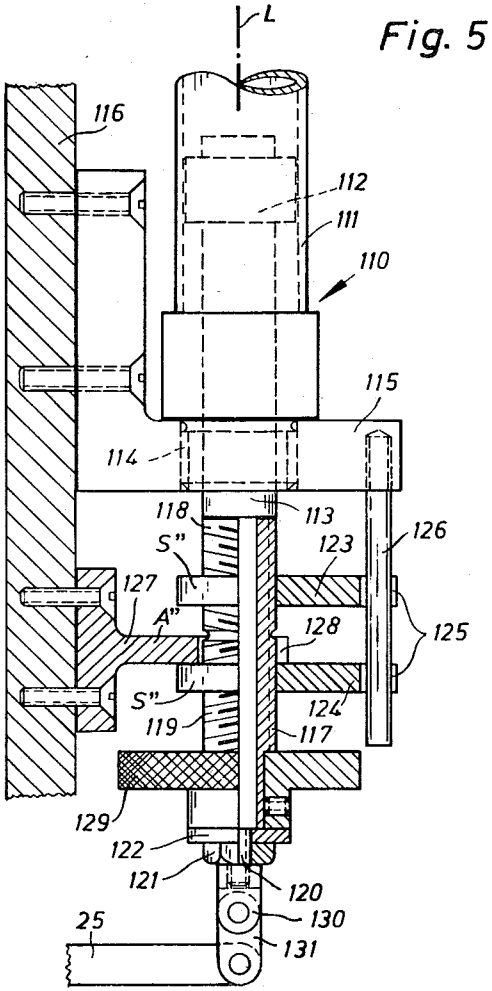
FIG. 5 is a view similar to FIG. 4 showing a third embodiment of a stitch setting device.

In still another embodiment, the stitch setting device comprises a double-acting air cylinder 110 of conventional design of which the housing 111, piston 112, and piston rod 113 are shown in FIG. 5. Air cylinder 110 is provided with a threaded shoulder 114 by which it is screwed into a bracket which is firmly screwed to the casing wall 116 of the sewing machine. A portion 111 of piston rod 113 extending outside housing 111 has a smaller diameter. On the portion 111 of the piston rod 113, a threaded sleeve 117 is mounted for rotation.

The external thread of threaded sleeve 117 is divided in two portions 118, 119 of which one is a lefthand thread and the other a righthand thread. The free end of piston rod 113 terminates with a threaded stud 120 of smaller diameter. Threaded sleeve 117 is axially fixed by means of a nut 121 screwed onto threaded stud 120 and a washer 122.

Threaded sleeve 117 carries two stop discs 123, 124, one on each of the two portions 118, 119, which are provided with corresponding internal threads. Each of stop discs 123, 124 is provided with one recess 125. A guide pin 126 secured to bracket 115 extends through recesses 125, so that stop discs 123, 124 are secured against rotation.

A contacting piece 127 fixed to casing wall 116 and provided with a recess for threaded sleeve 117 projects into the space between the two stop discs 123, 124. A setting wheel 129 is secured to the lower end of threaded sleeve 117. A forked head 130 is firmly screwed to the free end of threaded stud 120. With an interconnected link 131, forked head 130 is hinged to crank 25 as explained in connection with the first embodiment.

In this stitch setting device, the setting member S″ is embodied by the two oppositely displaceable stop discs 123, 124, while the contacting member A″ is embodied by the contacting piece 127.

The stitch setting device operates as follows:

In the embodiment shown in FIGS. 1 to 3, the zero position of piston 30, corresponding to the minimum possible distance between end parts 31, 32, the stitch length O is set. In this position, the axes of bolts 18, 21 are aligned with each other so that, with the sewing machine 1 on, links 16, 17 execute only pivotal motions about the respective bolts 18 and 21, while crank 22 stands still. In consequence since shaft 23 does not move either, feed dog 8 only executes the periodical up and down movements caused by lifting eccentric 11, but no feed movements.

To adjust a feed length, setting collar 47 is turned whereby end parts 31 and 32 are displaced in mutually opposite directions, in this instance apart from each other, so that cylinder chamber 47 and the path of stroke of piston 30 are extended. To sew forward, the piston surface facing end part 32, is loaded with compressed air, whereupon piston 30 applies against stop face 38 of end part 31. Thus, upon turning setting collar 47, piston 30 is displaced and, through piston rod 27, crank 25 is pivoted and shaft 20 is turned. This rotary motion of shaft 20 causes pivoting of crank 19, so that bolt 18 embodying the axis of rotation of link 16 is displaced relative to bolt 21 forming the axis of rotation of link 17. During the oscillatory motion of bolt 15 caused by eccentric bar 14, link 16 executes a purely pivotal motion about bolt 18, while link 17 also executes a relative motion about shaft 23, in addition to the pivoting motion about bolt 21. This relative motion is transmitted as pivotal motion of crank 22 to shaft 23 and to forked crank 24 by which feed motions are imparted to feed dog 8 through feed bar 9.

By turning setting collar clockwise or counter clockwise, the position of piston 30 relative to, or its distance from, the zero position is increased or reduced, so that the length of the feed step of feed dog 8 and the stitch length of the seam to be sewn is adjusted. The set stitch length can be read on a graduation 64 provided on end part 32, by means of the fixed indicator pin 63.

To sew backward, the space at the piston side facing end part 32 is vented and the surface of piston 30 facing end part 31 is loaded with compressed air, whereby piston 30 is displaced from end part 31 to end part 32 and impinges on stop face 39. Thereby, through piston rod 27, crank 25, and setting shaft 20, crank 19 is pivoted to the effect that bolt 18, which, during the forward sewing, was laterally behind bolt 21 as viewed in FIG. 2, moves through the position of alignment into a position laterally in front of bolt 21. In this way, the oscillatory motion of link 17 caused by shifting eccentric 13 is performed in phase opposition and feed dog 9 executes its feed motion in the backward direction. Since stop face 39 of end part 32 is always exactly equally spaced from the zero position as stop face 38 of end part 31, upon a reversal of the sewing direction, the feed length and the stitch length remain unchanged.

To perform the sewing operation without interruption or loss of time, the seam locking reversal or switching over of the feed direction must be effected very quickly. Consequently, piston 30 is moved from one to the other end part 31, 32 at high speed. As piston impinges on stop face 38, 39, its speed is abruptly braked down to zero and the kinetic energy is dissipated. The produced strong impact forces are taken up directly by the respective end part 31, 32 and transmitted, through setting collar 47, receiving ring 39, bolts 67, 68, and mounting plate 71, into the post 3 of sewing machine 1. Since these component parts are not moved during the feed reversal operation, they can be so dimensioned that their wear is prevented even with frequent reversals of the feed direction. On the other hand, the impact forces caused by the braking of piston 30 do not produce any effect on the transmission parts which are provided between the pressure fluid-operated cylinder 28 and the feed mechanism and which are moved upon a displacement of piston 30, so that there is no risk of overstressing these parts.

Since the stop faces 38, 39 are formed by relatively large annular surface areas and the front sides of piston 30 are flat, only a small specific contact pressure is produced at the impact of the piston on end parts 31, 32 and no risk of a premature wear of these component parts is incurred.

In the embodiment of FIG. 4, with stop discs 96, 97 at the maximum possible distance from each other, and resting against both the upper crossbar 85 and the lower crossbar 89, piston 82 can no longer be moved. In this position of stop discs 96, 97, the stitch length zero is set.

To set a feed, setting wheel 99 is turned, so that stop discs 96, 97 are moved toward each other. If a forward sewing is intended, the upper side of piston 92 is loaded with compressed air, with the effect that stop disc 97 applies against crossbar 89. By turning setting wheel 99, the air-loaded piston 82 is displaced whereby crank 26 is pivoted by means of piston rod 83. As already mentioned in connection with the first embodiment, a pivotal motion of crank 25 has the effect of adjusting a feed length of feed dog 8. By turning setting wheel 99 clockwise or counterclockwise, the distance of stop discs 96, 97 from their zero position and thereby the feed step of feed dog 8 determining the stitch length are reduced or increased.

If backward sewing is wanted, the upper side of piston 82 is vented, and the underside is exposed to compressed air, so that stop disc 97 is lifted from crossbar 89 and stop disc 96 applies against crossbar 85. Thereby, through piston rod 83, pivotal motion is imparted to crank 25 in the same way as in the first embodiment and the feed direction of feed dog 8 is reversed.

The impact forces produced at the reversal of the feed direction as stop discs 96, 97 abruptly impinge on crossbars 86, 89, are transmitted through housing 81 and bolts 86 to the casing of the sewing machine, and absorbed. These forces do not produce any effect on crank 25 nor on the farther component parts of the transmission, so that no risk of overstressing is incurred.

In the embodiment of FIG. 5 with the stitch setting device, a stitch length zero is set if stop discs 123, 124 are at a minimum possible distance from each other and apply against contacting piece 127 from both sides.

To set a feed, setting wheel 28 is turned so that stop discs 123, 124 move apart from each other. If forward sewing is desired, the upper side of disc 112 is exposed to compressed air, so that stop disc 123 comes to apply against contacting piece 127. By turning the setting wheel, piston 112 loaded with compressed air is displaced and, through piston rod 113 and link 131, crank 25 is pivoted. As already mentioned in connection with the first embodiment, a pivotal motion of crank 25 produces the effect of adjusting the feed step of feed dog 8. By turning setting wheel 25 clockwise or counterclockwise, the distance of stop discs 123, 124 from their zero position and, thereby, the feed step of feed dog 8 determining the stitch length, are reduced or increased.

The impact forces produced at the reversal of the feed direction by the abrupt impingement of stop discs 123, 124 on contacting piece 127 are transmitted to, and taken up by, casing 116 of the sewing machine partly directly through contacting piece 127 and partly through housing 111 and bracket 115. Thus, in this embodiment again, the impact forces do not produce any effect on crank 25 or on the following component parts of the transmission.

While specific embodiments of the invention have been shown and described in detail to illustrate the application of the principles of the invention, it will be understood that the invention may be embodied otherwise without departing from such principles.

What is claimed is:

1. In a sewing machine including a material engaging part engageable with a workpiece material to selectively feed the workpiece material in either forward or reverse directions in respect to a sewing needle for sewing stitches of selected length in the workpiece and a shifting mechanism for the engaging part which is adjustable for varying the amount of movement of the engaging part, the improvement comprising a stitch setting device for adjusting the length of stitch by varying the magnitude of movement of the engaging part, comprising a movable contact member connected to the shifting mechanism and being movable between two end positions to adjust the shifting mechanism by a selected amount so as to vary the amount of movement of the engaging part by a selected amount, first and second setting members disposed in the path of movement of said contacting member on respective opposite sides thereof and limiting the path of movement of the contacting member to a movement up to the engagement of the contacting member with the respective setting members disposed in the path thereof, and setting member positioning means connected to said first and second setting members and being movable in selected directions to move said first and second setting members in respective directions so as to vary the end position of movement of said contact member in accordance with the adjusted positions of said first and second setting members.

2. In a sewing machine according to claim 1, including a fluid pressure cylinder, said contacting member comprising a piston movable in said fluid pressure cylinder, and means for applying fluid to a selected side of said piston so as to vary the position thereof and to thereby vary the direction of feed of the material engaging part.

3. In a sewing machine according to claim 1, including a shifting mechanism connected to said contacting member comprising a driving eccentric, linkage means between said driving eccentric connected to the material engaging part including linkage members which may be shifted so as to vary the magnitude of movement of said eccentric on the material engaging part.

4. In a sewing machine according to claim 1, wherein said first and second setting members have respective stop surfaces disposed toward said contacting member on respective opposite sides thereof, means connected to said contacting member so as to shift said contacting member to vary the direction of feed of the material engaging part, said first and second setting members being connected to said contacting member, said second connecting member having a housing portion defining a fluid pressure operated cylinder, said contacting member being disposed in said cylinder and means mounting said first and second setting members for axial movement in respect to said contacting member in respective opposite directions.

5. In a sewing machine according to claim 4, wherein said setting members comprise end parts of cylindrical configuration, said setting member positioning means comprising a cylinder engaged over said end parts and enclosing therewith a fluid pressure cylinder, said contacting member comprising a piston movable in said cylinder, said first and second setting members being in sealing engagement with said cylinder and being axially movable in respect thereto.

6. In a sewing machine according to claim 5, wherein said cylinder comprises a sleeve having two axially spaced apart threaded interior portions, one of said setting members being threadably engaged with one of said threaded parts and the other being threadably engaged with the other threaded part, rotation of said sleeve being effective to displace said setting members in respective opposite directions and comprising said setting member positioning means.

7. In a sewing machine according to claim 1, including a holding ring (55), said setting cylinder having a collar portion secured to said cylinder and having an interior annular groove engaged by said ring.

8. A sewing machine in accordance with claim 7, including guide pins extending parallel to said cylinder sleeve and firmly fitted in said holding ring and extending to each side of said holding ring, said first and second setting members having guide bores for said guide pins.

9. In a sewing machine according to claim 1, wherein said first and second setting members comprise stop discs, said contacting member comprising a piston having a rod portion carrying said stop discs, a fluid pressure operated cylinder enclosing said contacting member piston, and fixed crossbar means disposed on respective sides of said setting members in the path of movement thereof so as to limit the travel of said piston in respective directions.

10. In a sewing machine according to claim 1, wherein said first and second setting members comprise a contacting piece, said contacting member comprising a piston having a rod portion carrying said stop discs, a fluid pressure cylinder enclosing said piston in which said piston is movable, said contacting piece being disposed between said first and second setting members.

11. In a sewing machine according to claim 1, wherein said first and second setting members comprise threaded members, means mounting said members having respective oppositely threaded engaged with respective first and second setting members being rotatable to move said first and second setting members in respective opposite directions, and means engageable with said first and second members to prevent their rotation so that they will move axially upon rotation of said member.

12. In a sewing machine including material engaging part engageable with a workpiece to selectively feed the workpiece material in either forward or reverse directions in respect to a sewing needle for sewing stitches of selected length in the workpiece and a shifting mechanism for the engaging part which is adjustable for varying the amount of movement of the engaging part, the improvement comprising a stitch setting device for adjusting the length of the stitch by varying the magnitude of movement of the engaging part, comprising a contact member having two end positions to adjust the shift mechanism by a selected amount so as to vary the amount of movement of the engaging part by a selected amount, first and second setting members disposed in a common path with said contacting member end positions and limiting a relative movement between the contacting member and the setting members to a movement up to the engagement of the contacting member end positions with a respective setting member in the common path, setting member positioning means connected to said first and second setting members and being movable in selected directions to move said first and second members in respective directions so as to vary the location of the engagement of said contact member with the setting members in accordance with the adjusted positions of the said first and second setting members, one of said first and second setting members and said contact member being connected to said shifting mechanism, and means for imparting the relative movement between said first and second setting members and said contact member connected to at least one of said setting members and contact member.

13. In a sewing machine according to claim 12, wherein said contact member comprises a piston and piston rod movable in a cylinder between said end positions, said first and second setting members comprising cap-like end parts restricting the movement of said piston and rod.

14. In a sewing machine according to claim 12, wherein said contact member comprises a single cross bar against which said first and second setting members come into contact, said end positions of said contact member defined on opposite sides of said cross bar.

15. In a sewing machine according to claim 1, wherein said contacting member comprises two cross bars disposed on respective sides of said setting members in the path of movement thereof so as to limit the travel of said setting members in respective directions.

* * * * *